US010370073B2

(12) United States Patent
Barnes et al.

(10) Patent No.: US 10,370,073 B2
(45) **Date of Patent: *Aug. 6, 2019**

(54) BOAT LIFT

(71) Applicant: Sea Power Boat Lifts, LLC, Mt. Pleasant, SC (US)

(72) Inventors: Sean A. Barnes, Mt. Pleasant, SC (US); Michael W. Kirby, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/143,737

(22) Filed: Sep. 27, 2018

(65) Prior Publication Data

US 2019/0023364 A1 Jan. 24, 2019

Related U.S. Application Data

(63) Continuation of application No. 15/467,399, filed on Mar. 23, 2017, now Pat. No. 10,086,919, which is a continuation-in-part of application No. 15/160,372, filed on May 20, 2016, now Pat. No. 9,604,709, which is a continuation-in-part of application No. 14/676,311, filed on Apr. 1, 2015, now Pat. No. 9,352,812, which is a continuation of application No. 14/077,854, filed on Nov. 12, 2013, now Pat. No. 9,132,897.

(60) Provisional application No. 61/725,506, filed on Nov. 13, 2012.

(51) Int. Cl.

| | |
|---|---|
| ***B63C 1/06*** | (2006.01) |
| ***B63C 3/06*** | (2006.01) |
| ***B63C 1/02*** | (2006.01) |

(52) U.S. Cl.
CPC ..... *B63C 1/06* (2013.01); *B63C 1/02* (2013.01); *B63C 3/06* (2013.01)

(58) Field of Classification Search
CPC ..... B63C 1/02; B63C 1/06; B63C 3/06
See application file for complete search history.

(56) References Cited

U.S. PATENT DOCUMENTS

| | | | |
|---|---|---|---|
| 3,270,698 | A | 9/1966 | Fort |
| RE27,090 | E | 3/1971 | Rutter |
| 3,603,276 | A | 9/1971 | De Lisle |
| 3,727,415 | A | 4/1973 | Williams |
| 3,967,570 | A | 7/1976 | Bradfield |
| 4,018,179 | A | 4/1977 | Rutter |
| 4,072,119 | A | 2/1978 | Williams |
| 4,276,849 | A | 7/1981 | Bloxham |
| 4,280,429 | A | 7/1981 | Wells |
| 4,510,877 | A | 4/1985 | Bloxham |
| 4,641,595 | A | 2/1987 | Pritchett |
| 4,763,592 | A | 8/1988 | Russ |

(Continued)

FOREIGN PATENT DOCUMENTS

| | | | |
|---|---|---|---|
| FR | 3017595 | * | 8/2015 |
| WO | WO2014035026 | | 3/2014 |

*Primary Examiner* — Frederick L Lagman
(74) *Attorney, Agent, or Firm* — B. Craig Killough; Barnwell, Whaley Patterson & Helms

(57) ABSTRACT

A floating boat lift having flotation tanks positioned under sides of a frame of the boat lift and a transverse flotation tank that communicates with the flotation tanks. Water flow is regulated so that tanks fill from near the center of the boat lift. Water is accepted into or pumped from the flotation tanks, allowing the frame of the boat lift to fall or rise relative to the surface of the water.

19 Claims, 20 Drawing Sheets

(56) References Cited

U.S. PATENT DOCUMENTS

| | | | | |
|---|---|---|---|---|
| 4,782,778 | A | 11/1988 | Barbaglia | |
| 5,002,000 | A | 3/1991 | Rutter | |
| 5,016,551 | A | 5/1991 | Peck et al. | |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A * | 1/1999 | Moody | B63C 1/06 114/263 |
| 5,860,765 | A | 1/1999 | Cruchelow et al. | |
| 6,477,968 | B2 | 11/2002 | Powell | |
| 6,526,902 | B1 | 3/2003 | Faber | |
| 6,547,485 | B2 | 4/2003 | Elson | |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,604,709 | B2 * | 3/2017 | Barnes | B63B 43/04 |
| 10,086,919 | B2 * | 10/2018 | Barnes | B63C 1/06 |
| 2002/0131821 | A1 | 9/2002 | Elson | |
| 2006/0156964 | A1 | 7/2006 | Canniffe et al. | |
| 2008/0276851 | A1 * | 11/2008 | Weed, Jr. | B63C 1/02 114/44 |
| 2008/0306642 | A1 | 12/2008 | Figura et al. | |
| 2009/0235857 | A1 * | 9/2009 | Hodapp | B63B 17/00 114/343 |
| 2011/0146554 | A1 | 6/2011 | Wright et al. | |
| 2011/0277675 | A1 | 11/2011 | Thom et al. | |
| 2014/0010593 | A1 | 1/2014 | Davis | |
| 2016/0264221 | A1 | 9/2016 | Barnes et al. | |

* cited by examiner

BOAT LIFT

This Application is a continuation of U.S. application Ser. No. 15/467,399 filed Mar. 23, 2017, now U.S. Pat. No. 10,086,919, issued Oct. 2, 2018, which is a continuation in part of U.S. application Ser. No. 15/160,372 filed May 20, 2016, U.S. Pat. No. 9,604,709, which is a continuation in part of U.S. application Ser. No. 14/676,311, filed Apr. 1, 2015, U.S. Pat. No. 9,352,812, which is a continuation of U.S. application Ser. No. 14/077,854, filed Nov. 12, 2013, U.S. Pat. No. 9,132,897, which claimed the benefit of U.S. Provisional Application No. 61/725,506 filed Nov. 13, 2012, the benefit of which is claimed hereby.

FIELD OF THE INVENTION

This invention relates to docks for boats and vessels generally, and is more specifically related to a boat lift.

BACKGROUND OF THE INVENTION

It is desirable to store boats out of the water when not in use. Particularly in salt water environments, water can lead to rapid corrosion of metal parts, and depreciation of other parts of the boat. Further, in many salt water environments, storage of the boat hull in the water leads to fouling of the hull, propellers and through hulls that communicate with boat utilities. Barnacle growth, for example, occurs in many salt water environments, and such fouling reduces performance of the boat hull and propulsion systems.

In one particular example, barnacles and other growth attributed to storing a boat hull in water occurs in through hulls and other openings in the hull. For example, barnacle growth in water inlets for jet boats that use water for propulsion or for boats that pumps water, such as firefighting vessels, experience fouling in the water intakes. While fouling on a boat hull is undesirable, fouling of water inlets or engine cooling could result in engine failures, and fouling in water inlets of vessels for emergency response can also be disastrous. It is expensive to frequently inspect and remove growth, such as barnacle growth, but is critical to do so if the boat is stored in water.

There is a need for a drive on boat lift that is reliable, and provides rapid, high lifting capacity, while also allowing the boat to be driven on to the boat lift at a generally horizontal attitude, so that the operator's vision is not obstructed by an elevated bow during the critical time while the boat is positioned at the dock.

SUMMARY OF THE INVENTION

The present invention is a floating boat lift having flotation tanks positioned under a frame of the boat lift. Flotation tanks fill from near the center of the boat lift. A preferred hingeable connection of the boat lift to a bulkhead, along with lateral stabilization, participates in maintaining a generally horizontal attitude for the boat lift. Water is accepted into or pumped from the plurality of flotation tanks, allowing the frame of the boat lift to fall or rise relative to the surface of the water. One or more catwalks along the sides of the boat lift and connected to the bulkhead may float at a level that is independent of the boat lift frame.

BRIEF DRAWING DESCRIPTION

DESCRIPTION OF PREFERRED EMBODIMENTS

Figure 6:
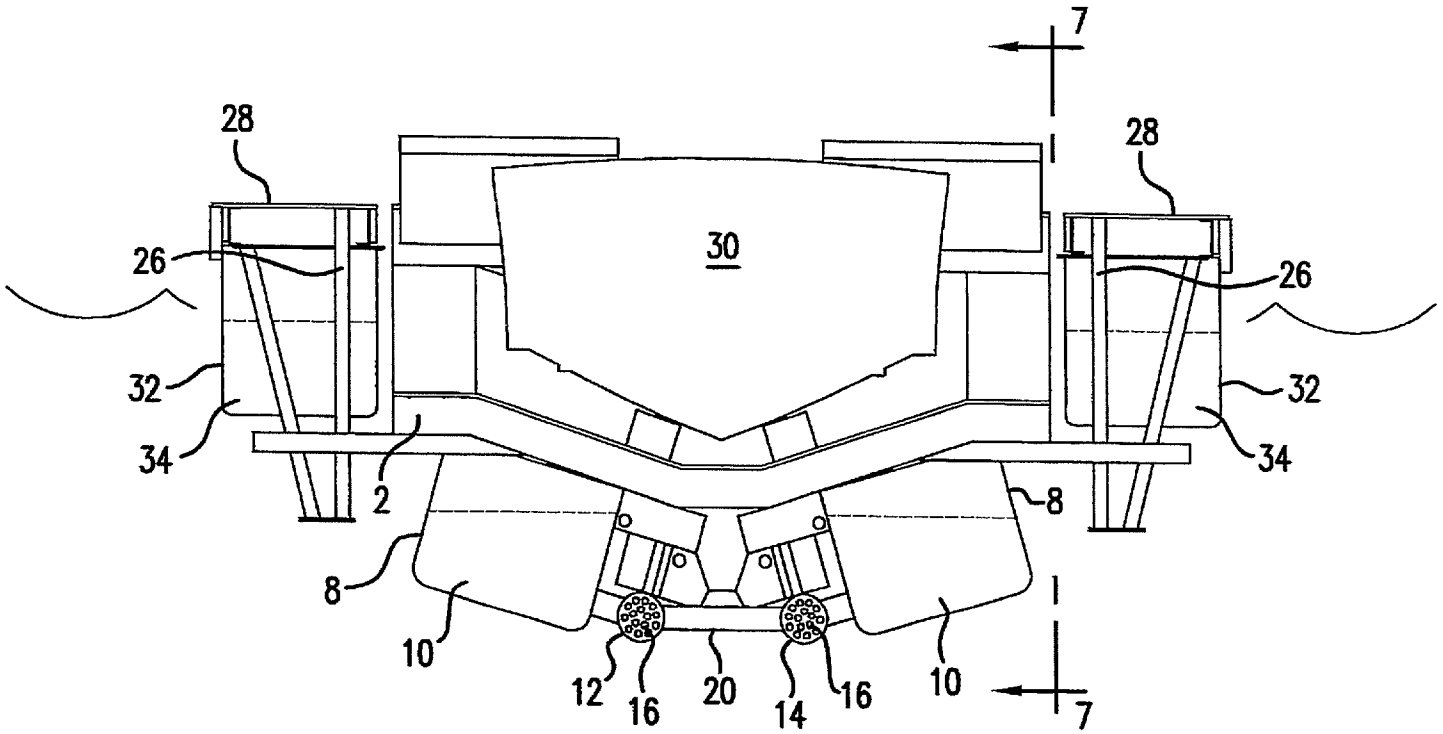
FIG. 6 is a rear elevation of the boat lift with a boat in position on the boat lift, and the boat lift in a relatively lowered position.

In preferred embodiments, a boat lift comprises a frame 2 or similar sub-structure. The frame may generally have a v-shape to accommodate the common shape for boat hulls, so that the frame is constructed and arranged to receive and hold a boat hull in a stable and generally horizontal position. FIG. 6. The frame may be covered with planking 4, which may be wood, and which may be teak, as demonstrated in the drawing figures. The frame may be covered with other materials, which may be synthetic rubber or other elastomers or polymers that will receive and hold the boat hull without damaging the boat hull other materials of which docks and boat lifts are formed of may be used.

A hinged frame section 6 of the boat lift connects the frame to a bulkhead, which may be floating. The hinged boat lift section is hingeably connected to the frame and hingeably connected to the floating bulkhead. The hinged boat lift section may be covered with the planking 4 or other material of which the frame of the boat lift is covered. The bulkhead is preferred to be floating in most cases. In addition, it may be a fixture in some manner to real estate.

Positioned underneath the boat lift frame is a plurality of flotation tanks 8. A first plurality of flotation tanks is positioned along one side of the boat lift frame, and a second plurality of tanks is positioned along a second side of the boat lift frame. The tanks are constructed and arranged to be flooded with water, and subsequently to have water evacuated from the tanks to cause submersion of the boat lift frame, and lifting of the boat lift.

Figure 8:
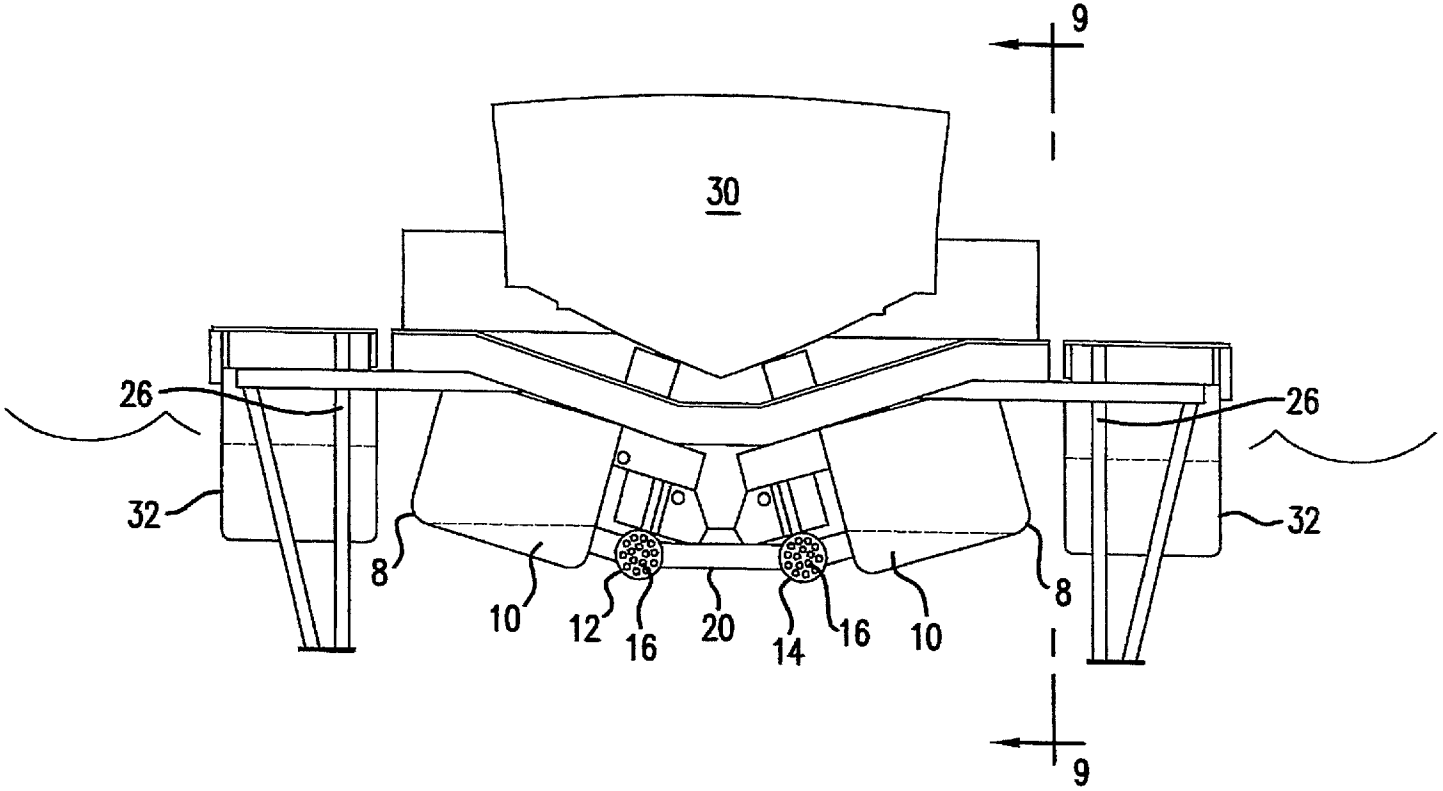
FIG. 8 is a rear elevation of the boat lift with a boat in position on the boat lift, and the boat lift in a raised, elevated position.

In a preferred embodiment, the flotation tanks are rectangular in cross-section, as shown in drawings. A rectangular cross section may include a square cross section. As shown in FIG. 6 and FIG. 8, the bottom of the flotation tanks is at an angle from horizontal. In a preferred embodiment, this angle will be between 10 and 45 degrees from horizontal. As shown particularly in FIG. 8, when the tanks are evacuated of water 10, the remaining water will settle in the lower most portion of the tank, and in a corner thereof due to the angle of the tank. Causing the remaining water to flow to the corner of the generally horizontal tank provides for the most evacuation of water, since the pick up for the conduit to the water pump may be located in this corner. If the tanks are mounted so that the bottom is substantially horizontal, evacuation of the water is not as complete. The rectangular cross section, in many cases, provides a flat top surface for mounting the tanks against the upwardly angled surface of the boat lift frame that is generally v-shaped in the preferred embodiment shown in FIGS. 6 and 8. The frame of the boat lift may be horizontal all the way across (FIG. 21), or otherwise shaped according to the vessel to be received on the boat lift.

In a preferred embodiment, a first trunk line 12 and a second trunk line 14 are positioned between the first plurality of flotation tanks and second plurality of flotation tanks. The first trunk line and a second trunk line are generally parallel to each other, positioned horizontally, and run longitudinally underneath the boat lift frame and between the first plurality of flotation tanks and second plurality of flotation tanks and substantially the length of the frame 2.

Each trunk line has a water receiving port 16 positioned in a rear of the trunk line, which is near the rear of the boat lift frame. The rear of the boat lift frame is defined as the end of the boat life frame that is generally adjacent to the stern of a boat 30 when a boat is in position on the boat lift, as shown in the drawing figures. The water receiving port of the trunk lines is preferred to be near the rear of the boat lift, since typically, boats are heavier at the rear. While the device is designed to use multiple complimentary components to submerge and raise the frame at a relatively horizontal and level attitude, it is preferred that the water receiving ports are held under the water by the rearwardly biased weight of most vessels.

Each trunk line communicates by a flow limiting conduit 18 that connects the associated trunk line to the associated flotation tank. For example, the trunk line associated with the flotation tanks on the left side of the boat lift will have a flow limiting conduit connecting the trunk line to each of the flotation tanks, such that if there are three flotation tanks, there will be three flow limiting conduits from the associated trunk line to the left side of the flotation tanks. Similarly, the trunk line on the right side will be connected by a flow limiting conduit from the trunk line to each of the three flotation tanks so that three flow limiting conduits run from the trunk line to the three flotation tanks. Further, a conduit 20 connects the first trunk line to the second trunk line.

Several elements of the invention permit the boat lift frame to be submerged while maintaining a relatively horizontal position. The use of multiple flotation tanks, each having a flow limiting conduit from a trunk line, regulates the flow of water into each of the tanks. As the valves on the rear of the trunk lines associated with the ports 16 are opened by an actuator (FIG. 10), which is preferably a pneumatic actuator housed in a sealed, water proof housing, water floods the trunk lines. If multiple flotation tanks are not used, the weight of the boat would tend to cause the rear portion of a single tank to flood at rear, preventing the boat lift from descending evenly. The use of the trunk line with the flow limiting conduit means that water is available for each of the conduits from the trunk line in a relatively even volume and relatively even flow rate, so that the plurality of flotation tanks, such as three flotation tanks, fills evenly. Further, having a conduit that communicates water from the first trunk line to the second trunk line also assures that water is available for both trunk lines, and that relatively the same volume of water is present in each of the trunk lines, so that the plurality of tanks on each side of the boat lift frame all fill at generally the same rate, keeping the boat lift at a proper attitude.

Further, mounting the boat lift frame to the floating bulkhead 22 or similar stationary mounting allows the boat lift frame to descend with a generally horizontal attitude. By hinging the hinged frame section at the front of the boat lift frame and at the floating bulkhead or similar stationary mounting, the boat lift frame descends and ascends relatively evenly.

Figure 1:
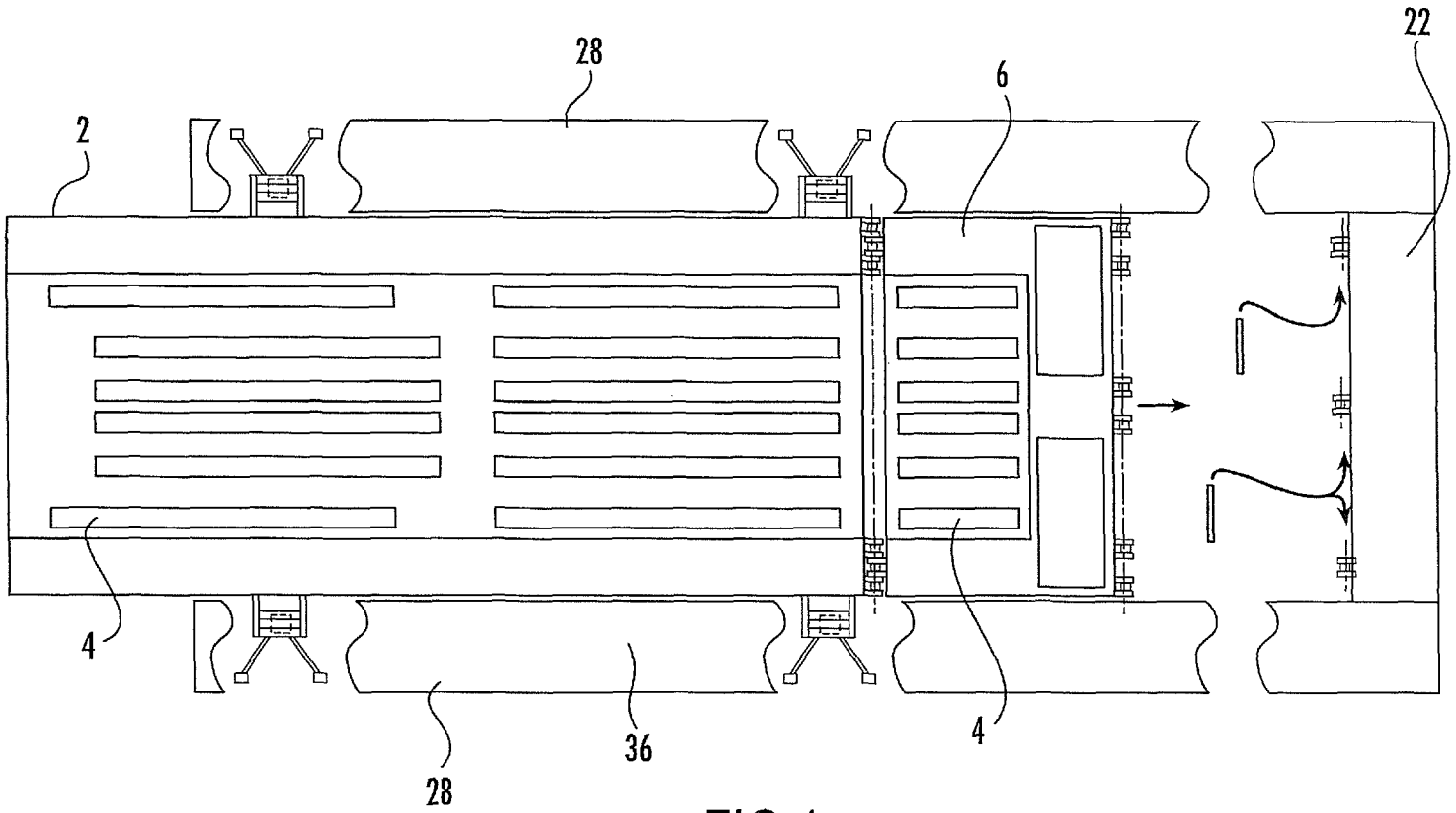
FIG. 1 is top plan view of the dock demonstrating an attachment of a hinge that attaches the hinged frame section of the lift to a floating bulkhead.
Figure 2:
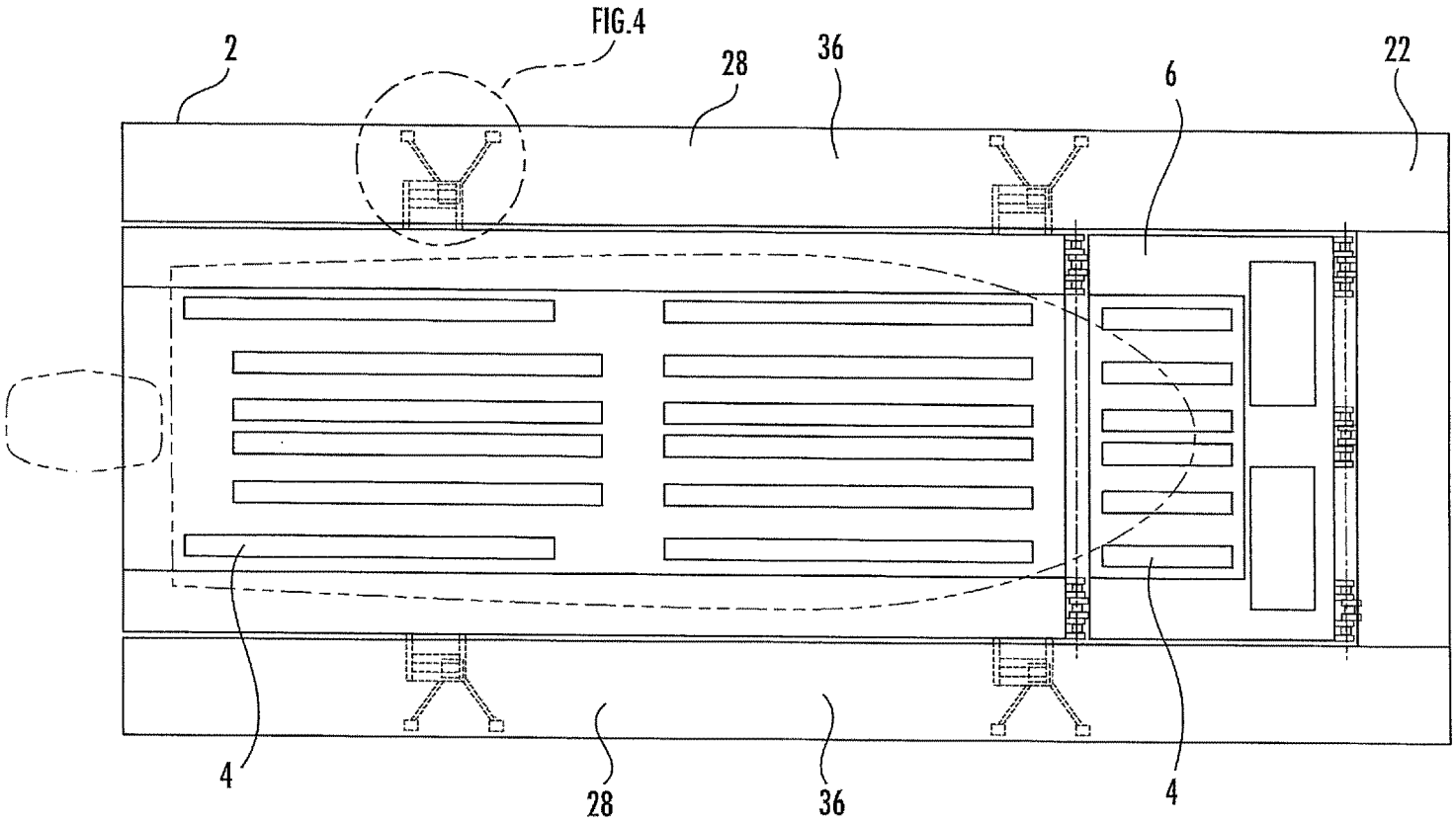
FIG. 2 is a top plan view of the dock of FIG. 1 with the dock in place and the hinged frame section attached to the floating bulkhead.
Figure 3:
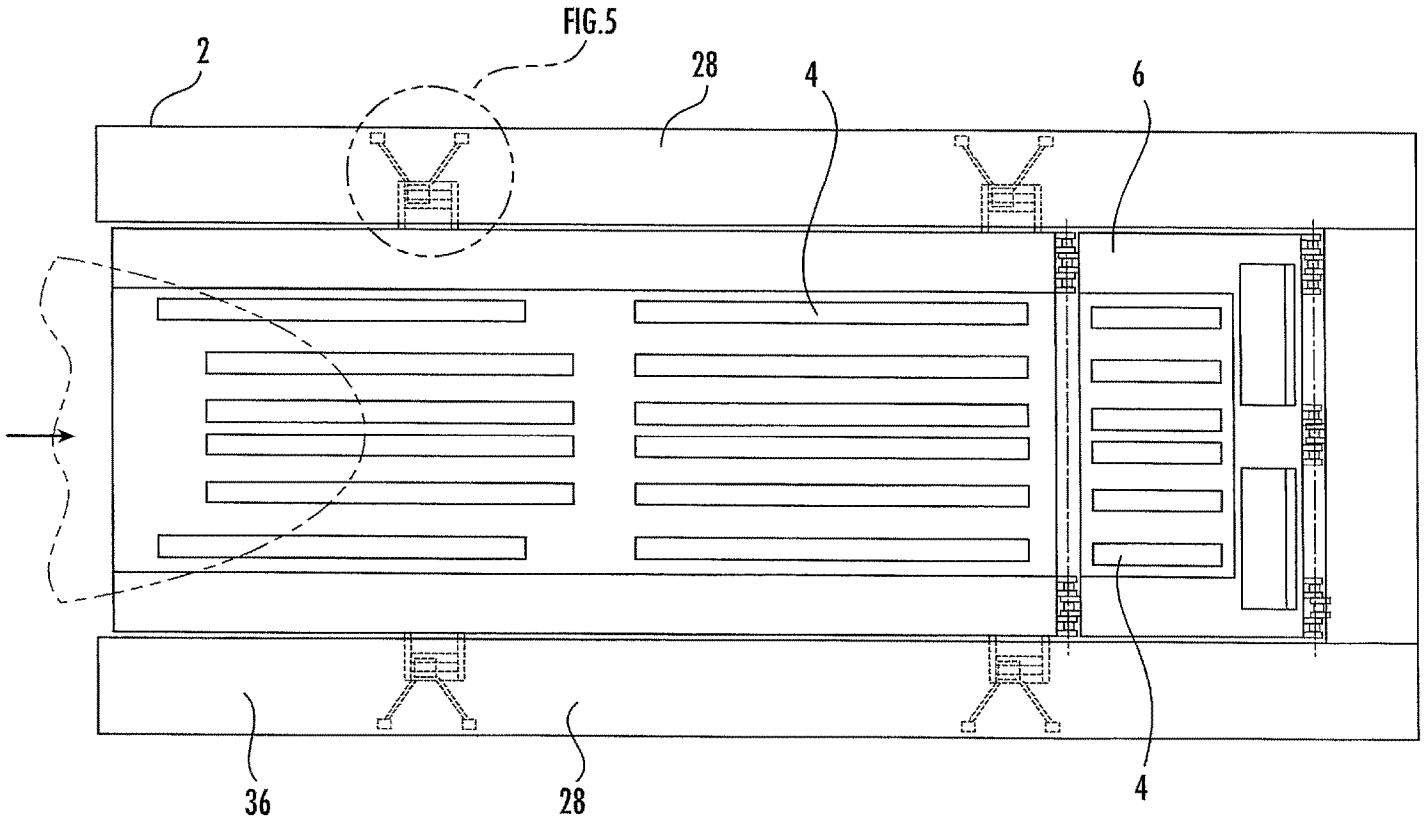
FIG. 3 is the top plan view of the dock of FIG. 2 demonstrating a boat shown in phantom lines entering the boat lift.
Figure 4:
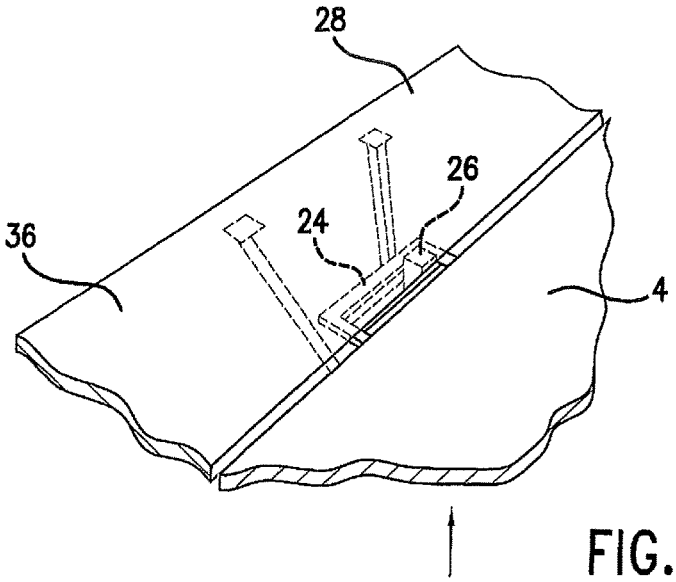
FIG. 4 is an isolation taken essentially as shown in FIG. 2, with a lateral stabilizer positioned in the boat lift frame, with the boat lift in a raised, upper position.
Figure 5:
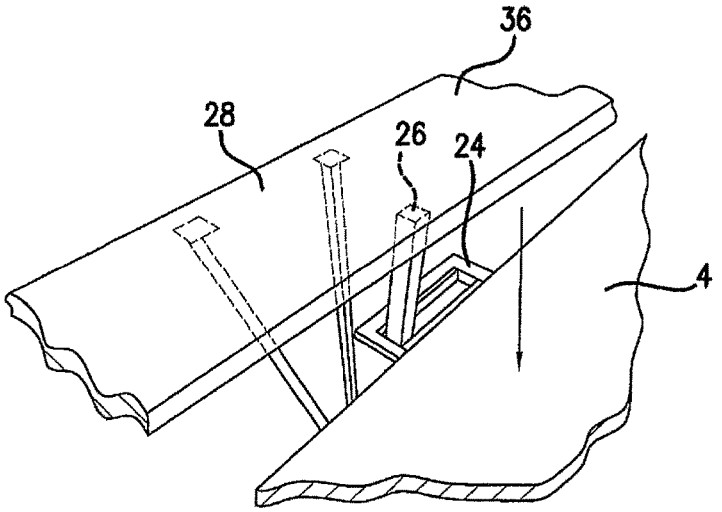
FIG. 5 is an isolation essentially taken as shown in FIG. 3, with a lateral stabilizer positioned in the boat lift frame, with the boat lift in a lowered position.

Mounting of the boat lift to the lateral stabilizers as shown in FIG. 4 is also important to the boat lift in descending and ascending at a relatively even attitude. Due to the movement of the hinged frame section 6, the boat lift frame will be moved forward as the boat lift frame descends to the position of FIG. 7, and pushed to the rear by the movement of the hinges of the hinged frame section shown in FIG. 9. At least two (2) hinges on each end of the hinged frame section is preferred. The slotted mounting brackets 24 shown in FIGS. 4 and 5 permit forward and rearward movement of the boat lift, maintaining the desired attitude. Lateral stabilizers 26 are positioned within the slotted mounting brackets to prevent movement of the boat lift at a right angle to the forward and rearward travel of the boat lift during normal operation. These slots, while permitting movement of the boat lift in one direction (such as forward and rearward), retard movement of the boat lift in other directions (such as side-to-side). The slots also prevent the boat lift from being pushed to an undesired attitude by wave action striking the side of the boat lift. The lateral stabilizers in a preferred embodiment are also used as mounting for the catwalk 28, which may run the length of the boat life frame on one or both sides of the dock. In a preferred embodiment, the floating dock is "free standing" except for the engagement of the slotted mounted brackets 24 with the lateral stabilizers 26.

The preferred catwalks 28 are supported by flotation tanks 32. The flotation tanks are water tight, but provide a water inlet and/or outlet for filling the tanks or withdrawing water from the tanks. During construction and/or positioning of the dock, catwalks are positioned alongside the boat lift frame. The flotation tanks are filled with water 34 to a level of the flotation tanks that holds the catwalk in the desired position relative to the boat lift frame, so that the top decking 36 of the catwalks, which may be covered similarly or identically to the boat lift frame, are at the desired position relative to the decking of the boat lift frame. Once the water level in the flotation tanks of the catwalks is sufficient to hold the catwalk in the desired position, it should not be necessary to frequently adjust the flotation tanks' water level. In a preferred embodiment, when the boat lift frame has lifted the boat to the full upper position, so that the hull of the boat is out of the water, the decking of the boat lift frame, where it joins the catwalk, and the decking of the catwalk will be relatively even each with the other. Occupants of the boat may ingress and egress the boat by traversing the catwalk or the hinged frame section, without the decking of any of these elements presenting a tripping hazard.

Figure 7:
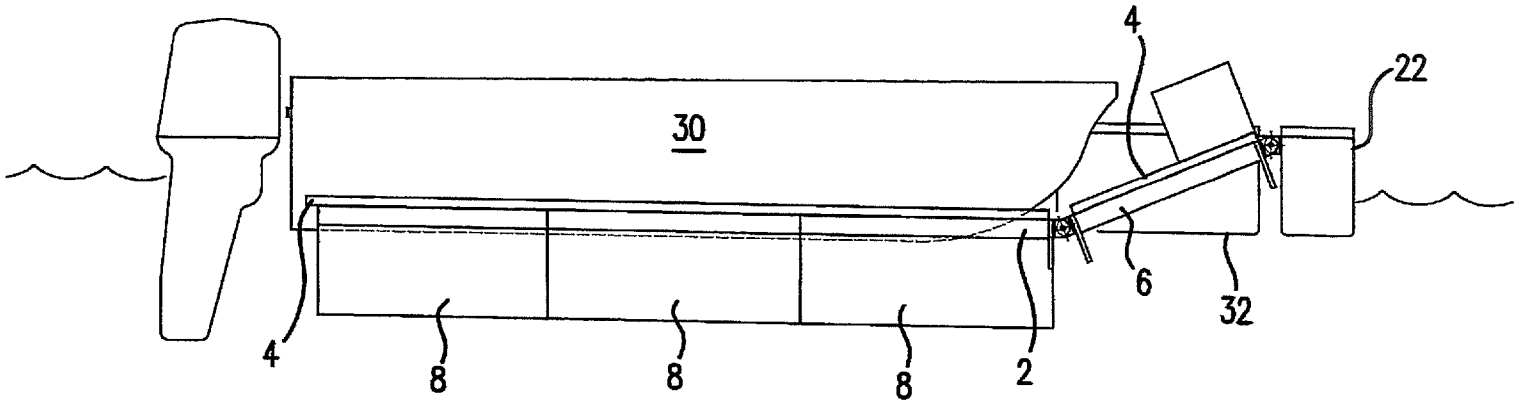
FIG. 7 is a side elevation of the boat lift and boat of FIG. 6.
Figure 9:
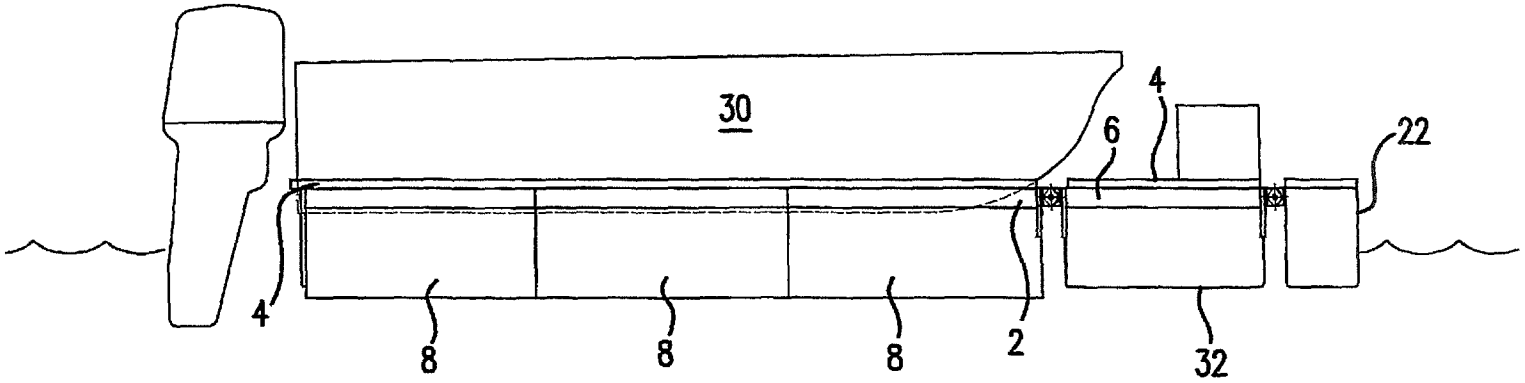
FIG. 9 is a side elevation of the boat lift and boat of FIG. 8.

In a preferred embodiment, the floating bulkhead, the catwalks 28, bulkhead 22, frame 2, planking 4, and hinged frame section 6 are connected as shown in the drawing Figures and the entire assembly is floating. FIG. 7; FIG. 9 The construct is held in position relative to the body of water in which it floats by the brackets 24 and the stabilizers 26. The hinged construction allows the catwalks, the frame in which the boat is positioned, and the floating bulkhead to each be positioned with the top surface each at a different level, which is a level that is most suitable for each component, even though each of these components is floating and interconnected. The catwalks may be caused to float by regulating a water level in associated tanks as described herein. The floating bulkhead is floating due to its own flotation (as used with the catwalks being positioned under the bulkhead) and due to being connected to the catwalks and the boat lift, and the floating height adjusted by the water level in the tanks, as described with the catwalks. Additional flotation may be provided by the use of tanks like tanks 32 positioned under the hinged frame section 6.

Figure 10:
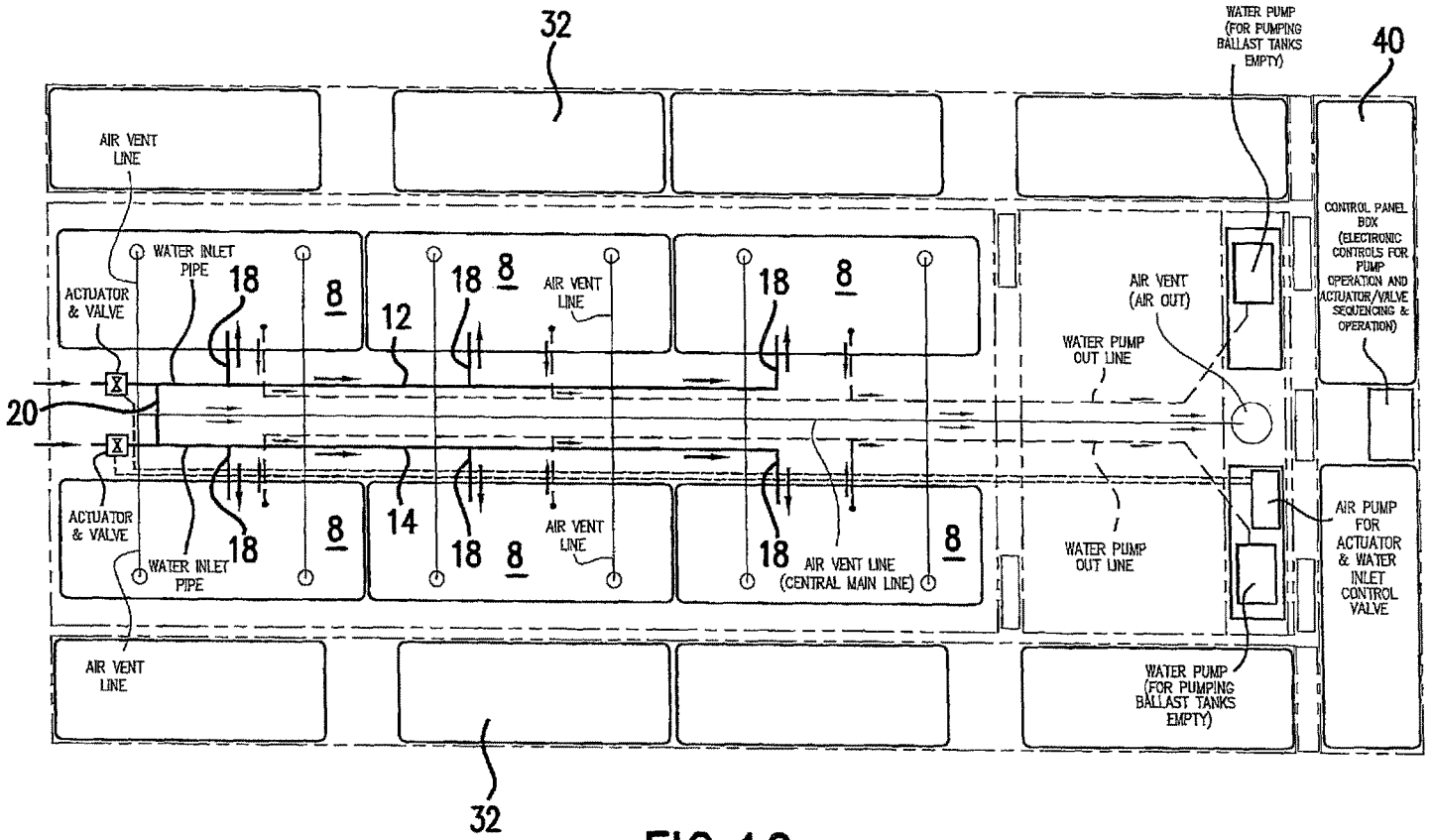
FIG. 10 is a schematic demonstrating operational air and water flow for the boat lift.

A preferred schematic of the operational elements is shown in FIG. 10. The left side of the schematic represents the rear of the boat lift. Arrows demonstrate water entering the water receiving ports 16 of the preferred parallel trunk lines. A valve is associated with each water receiving port, and the valve may be fully or partially opened, and fully or partially closed, as desired, to allow water to flood the trunk lines. As further demonstrated by arrows between the trunk lines and the flotation tanks, water flows through the flow limiting conduits to the flotation tanks 8. A conduit also permits flow between each of the trunk lines. Air vents are provided in an upper portion of each of the flotation tanks as shown, to allow air to evacuate the flotation tanks as water floods the flotation tanks. Air vent lines connect the air vents in this embodiment.

The force of gravity holds the openings of the trunk lines under water, with the water entering the flotation tanks with the valves of the trunk lines open. The valves are controlled by one or more actuators. The actuator(s) are preferred to be pneumatically controlled with an air compressor providing air pressure for actuating the valve by means of the actuator. Operation of the valves, and therefore filling of the flotation tanks, may further be controlled by a timer, or by a water level sensor. When the flotation tanks are filled with water, the boat lift frame, and any associated boat or vessel, is submerged to a depth that allows the boat to float in water, and be driven on or off of the boat lift frame and the decking thereof. In one embodiment, only one inlet, valve and actuator is used to allow water to flow into flotation tanks.

An air vent communicates with the air vent lines as shown in the schematic. In a preferred embodiment, the air vent is positioned near the front of a boat lift as shown in FIG. 10. The air vent has a valve associated with it, and the valve may also have an actuator that operates the valve to a fully opened or fully closed or partially open or partially closed position. The actuator may be pneumatically operated and controlled. By controlling the rate of flow of air out of the air vent, the rate of submersion of the boat lift can be controlled. In a preferred embodiment, the openings of the trunk lines and water flow from the trunk lines into the flotation tank are sufficient to allow the boat lift to travel from fully raised to fully submerge in less than one minute. However, by limiting the degree of opening of the air vent, and thereby limiting the rate of flow of air out of the flotation tanks, the rate of water entering the flotation tanks, and therefore the rate of submersion, may also be controlled.

The boat lift is raised by evacuating water from the flotation tanks and replacing the water with air. In a preferred embodiment, evacuation of the water is performed by pumping the water from the flotation tanks, using one or more water pumps. To accomplish water evacuation from the flotation tanks, the ports of the trunk lines at the rear of the boat lift are closed by the actuators. Water is then pumped from the flotation tanks and trunk lines and out of the device through water pump out lines that communicate with each of the flotation tanks.

During the water evacuation process, the air vent will remain open so that air replaces water that is evacuated. The water flow rate may be regulated by partially closing the air vents. However, in most cases, the air vent will remain fully open, since rapid evacuation of water, and the associated lifting action, is desired to occur relatively rapidly. Sensors may be provided so that when there is no water flow to the water pumps, or an individual pump of a plurality of water pumps, operation of the pump or pumps is terminated.

In a preferred embodiment, a central control panel 40 for operating the boat lift is provided. The control panel may have a simple command selector to raise or lower the boat lift. Other controls may control the rate of flow of water and/or air in and out of the flotation tanks by operation of the valves as discussed herein. In other embodiments, manual controls for actuating the pumps or terminating operations of the pumps may be provided.

In some embodiments, the boat lift frame is built in a plurality of sections, with one flotation tank positioned on each side of the modular section. The sections of the frame may be attached with fasteners that are removable, such as nuts and bolts, rather than welding the entire length of the frame together. In this manner, a modular boat lift that may be built to a customized length by adding or removing sections is available. As shown in the drawings, three frame sections are connected, with each frame section comprising an associated flotation tank. More, or fewer, sections could be used to vary the length of the boat lift.

Figure 11:
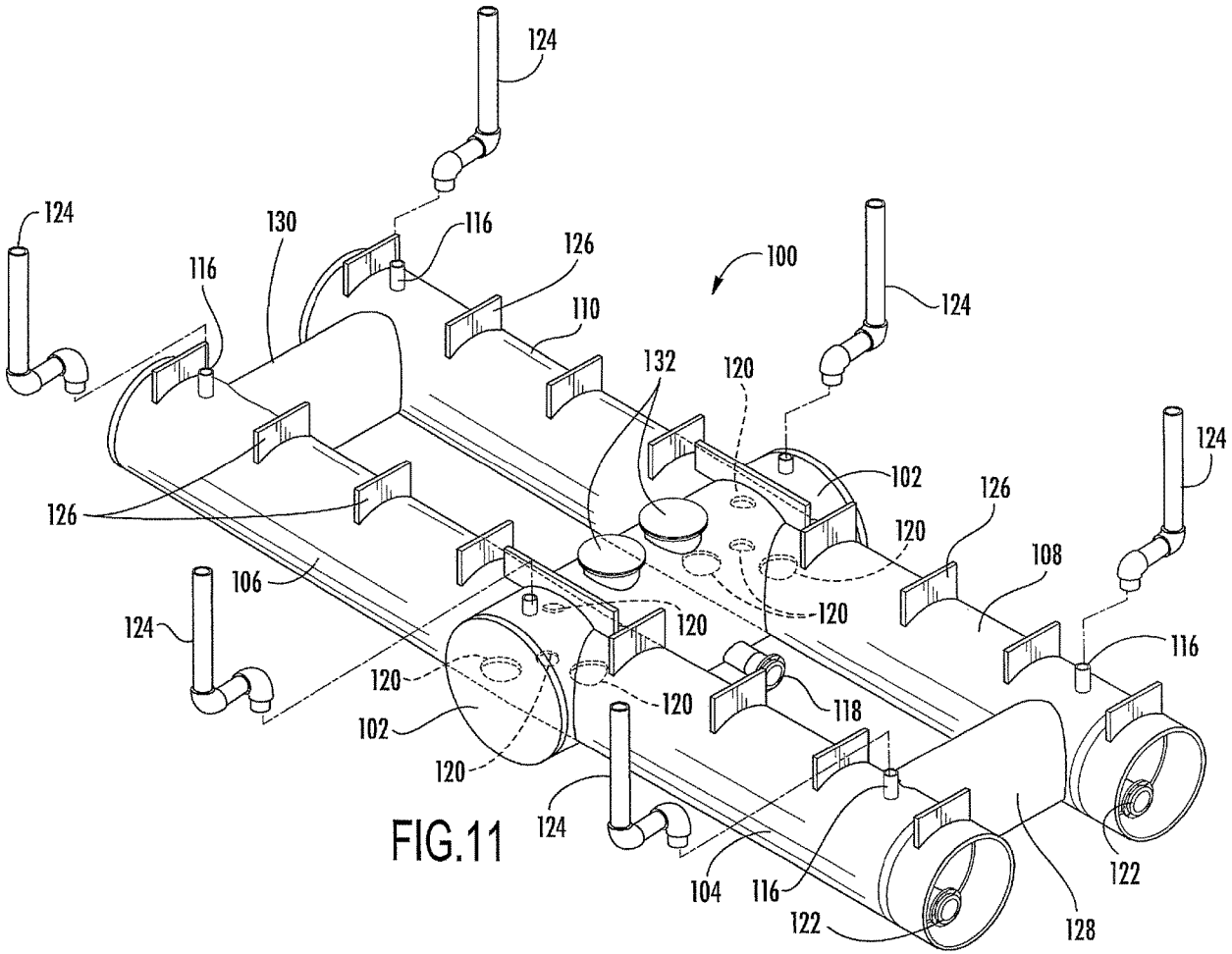
FIG. 11 is perspective view of another embodiment of flotation elements for the frame of the boat lift.

FIG. 11 shows another construct 100 that provides selective flotation of the boat lift frame. In this embodiment, the construct comprises five flotation tanks that are joined together and which are in hydraulic communication with each other, that is, water flows between the tanks.

A first embodiment of FIG. 11 shows a transverse tank 102 that may be positioned at or near the center of the construct. Four flotation tanks are connected to the transverse flotation tank, and may be designated as first flotation tank 104, second flotation tank 106, third flotation tank 108 and fourth flotation tank 110. In this example, the first flotation tank is connected at one end to the transverse flotation tank. The second flotation tank is connected at an end to the transverse flotation tank, and opposite the side of the transverse flotation tank to which the first flotation tank is connected. The third flotation tank is connected at an end to the transverse flotation tank. The fourth flotation tank is connected to the transverse flotation tank and opposite the side of the transverse flotation tank to which the third flotation tank is connected.

The resulting construct is one in which the first and second flotation tanks are positioned generally parallel to the third and fourth flotation tanks. Each of the first flotation tank, second flotation tank, third flotation tank, fourth flotation tank are generally perpendicular to the transverse flotation tank as shown.

In a second embodiment of FIG. 11, a first flotation tank and a second flotation tank are generally parallel to each other and extend entirely through the transverse tank 102. The first flotation tank may be considered to have a first side 104 and a second side 106, even though each of the first flotation tank and the second flotation tank is a unitary construct. The second flotation tank may be considered to have a first side 108 and a second side 110. The first and second flotation tanks may be generally perpendicular to the transverse flotation tank as shown. One skilled in the art will recognize that characteristics of the first embodiment of FIG. 11 as disclosed and described herein are generally applicable to this second embodiment. Alternatively, the boat lift could be constructed to have a first flotation tank that extends through the transverse tank and a generally parallel flotation tank constructed as a third flotation tank and a fourth flotation tank as in the first embodiment.

Pumps are used to pump water out of the flotation tanks. The water is replaced with air, which causes the flotation tank construct to float. Water is pumped from the flotation tank construct and replaced with air, so that the boat lift frame floats at the desired level.

Figure 12:
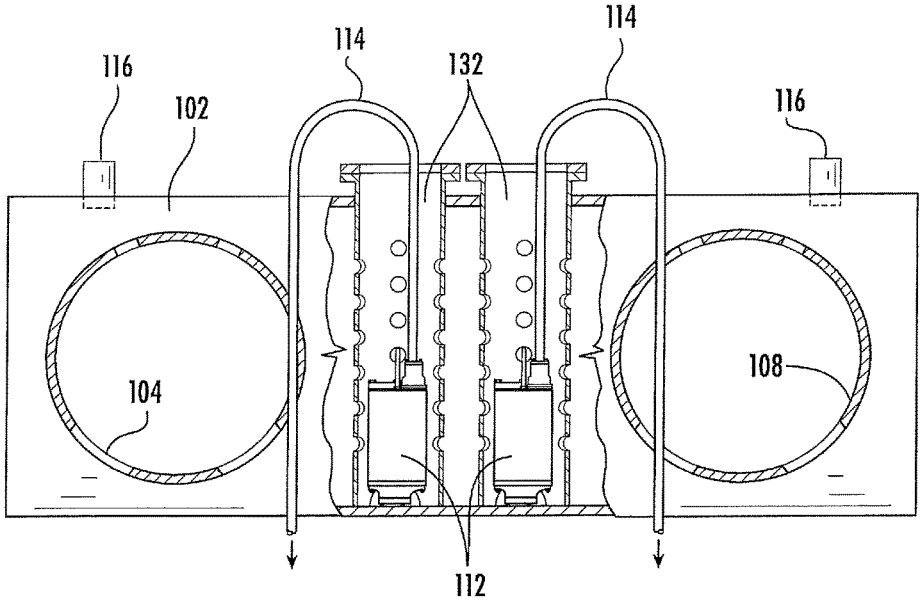
FIG. 12 is an elevation of the flotation elements of FIG. 11, cut away to show pumps in a transverse flotation tank.

In a preferred embodiment, submersible pumps 112 are positioned within the transverse flotation tank. FIG. 12. Each pump may be inserted into a pump sleeve 132 that houses each pump. The pump sleeves may be formed of high density polyethylene pipe that is perforated to allow adequate water flow intake and exhaust. The submersible pumps are positioned at or near a center of the transverse flotation tank so as to balance the flotation tank construct, and also to remove water relatively uniformly from the flotation tank construct, thereby maintaining balance during the process of pumping water from the flotation tank construct. The submersible pumps may be submersible pumps such as those manufactured by Gorman-Rupp.

Water is pumped by the pumps through one or more outlets 114, which are preferred to open below the flotation tank construct and, therefore, below the water line. Air vents 116 that communicate with the flotation tanks cause air to enter the flotation tanks as water is pumped from the flotation tank construct.

Water receiving inlets 118 communicate with the flotation tank construct. In a preferred embodiment, the water receiving inlet or inlets are positioned near the center of the flotation tank construct, and more preferably, are positioned to communicate directly with the transverse flotation tank 102. By positioning the water receiving inlets in this embodiment near the center of the flotation tank construct, such as near the generally centralized transverse flotation tank, water enters the flotation tank construct near the center thereof, balancing the boat lift frame as it fills with water. The water receiving inlets may have relatively short trunk lines so as to not position the opening or openings to the inlets far from the center of the flotation tank construct.

Opening and closing the water receiving inlets is preferred to be formed by a valve for each inlet. The valve is remote controlled and may be electrically actuated. The valves and electric actuator may be those such as those manufactured by Rotork.

In the preferred embodiment, the transverse flotation tank, first flotation tank, second flotation tank, third flotation tank and fourth flotation tank may be constructed of high density polyethylene (HDPE) and may be formed of HDPE pipe. The first flotation tank, second flotation tank, third flotation tank, and fourth flotation tank may be mounted to the transverse flotation tank as shown in the drawings by welding or fusing methods for HDPE.

When the flotation tanks are welded or fused to the transverse flotation tank about the perimeter of the ends, as shown in the drawing Figures, water communication passages 120 are formed between the transverse flotation tank and the other flotation tanks so that there is hydraulic communication between all tanks. These passages should be formed on lower portions of the flotation tanks to insure draining, and be of sufficient size to allow for rapid evacuation of water from the flotation tanks.

It is preferred that the first flotation tank, second flotation tank, third flotation tank and fourth flotation tank incline away from the transverse flotation tank (FIG. 14, FIG. 16) so that water flows from the ends of the flotation tanks toward the transverse flotation tank due to gravitational pull. In one embodiment, the first flotation tank, second flotation tank, third flotation tank, and fourth flotation tank are inclined away from the transverse flotation tank at an angle of 2 degrees to 5 degrees from horizontal, particularly along the bottom portion of these flotation tanks.

A flotation construct as described above may be mounted under the frame and/or deck of the embodiment of the boat lift shown in FIGS. 6-9. See, in particular, FIGS. 13-16. Mounting tabs 126 may be used to mount the flotation tank construct to the frame 2.

Optionally, or additionally, water receiving inlets 122 may be positioned near an end of the second flotation tank and fourth flotation tank that are opposite the ends thereof mounted to the transverse flotation tank. Positioning water receiving inlets at the end of these flotation tanks may be preferred where water is shallow and the bottom of the body of the water slopes upwardly from the rear of the boat lift toward the front of the boat lift. The water receiving inlets 122 may have electrically actuated valves.

Structural members may be provided. In the embodiment shown, transverse members 128, 130 are positioned opposite the transverse flotation tank 102. These members may be hollow, but water tight, to provide additional flotation, and may or may not hydraulically communicate with the adjoining tanks. The transverse members may be filled or partially filled with water or other material to provide ballast. By positioning one transverse member near the rear of the boat lift and one near the front of the boat lift, the transverse members may be used to vary flotation or ballast at the front and rear of the boat lift depending upon the size and configuration of the vessel and vessel power. As with the flotation tanks, transverse tanks and auxiliary tanks, the transverse members may be formed of HDPE.

Figure 13:
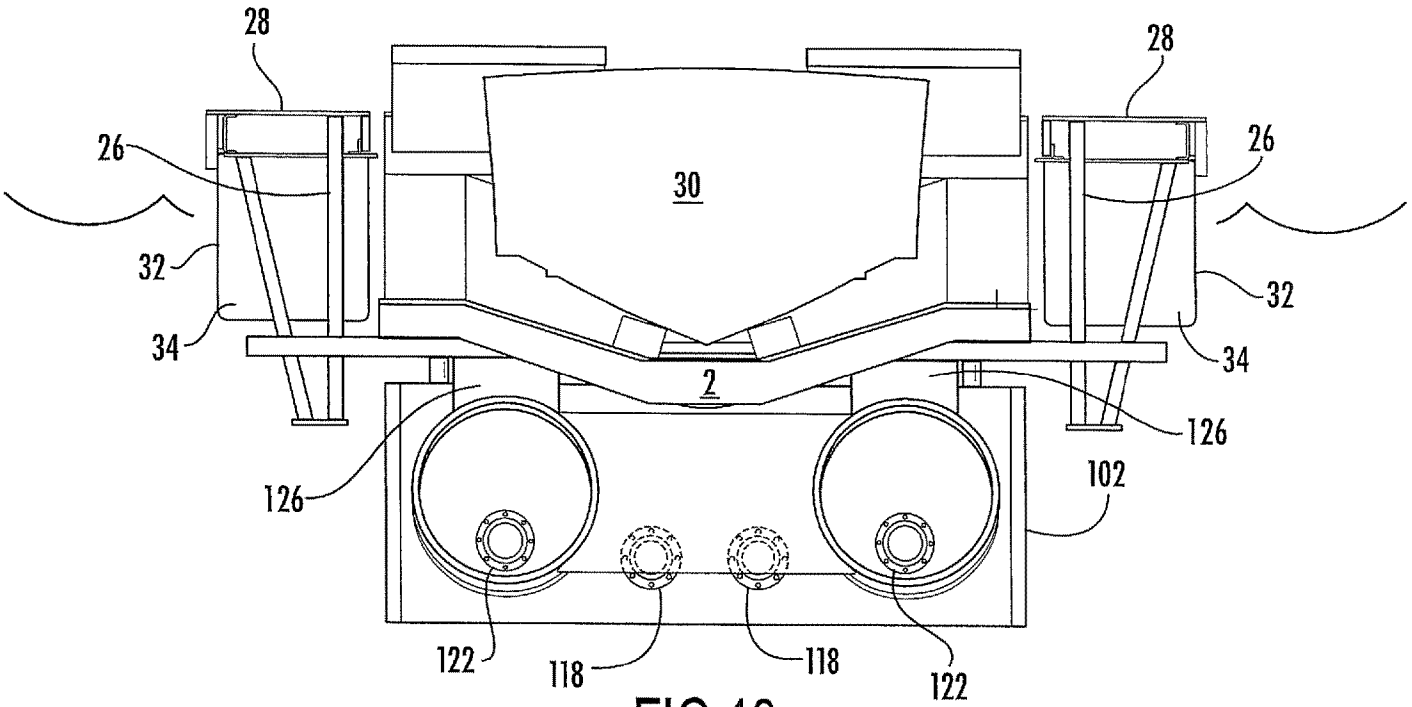
FIG. 13 shows a rear elevation of the flotation elements of FIG. 11 mounted under the boat frame with the boat lift partially submersed.

In use, the flotation construct is partially or completely filled with water so that the frame of the boat is below the water line. FIG. 13. Please note that the catwalk and bulkhead is shown to float at a relatively constant height since the flotation tanks where the catwalks and the bulkhead are independent of the flotation construct of FIG. 11.

Figure 14:
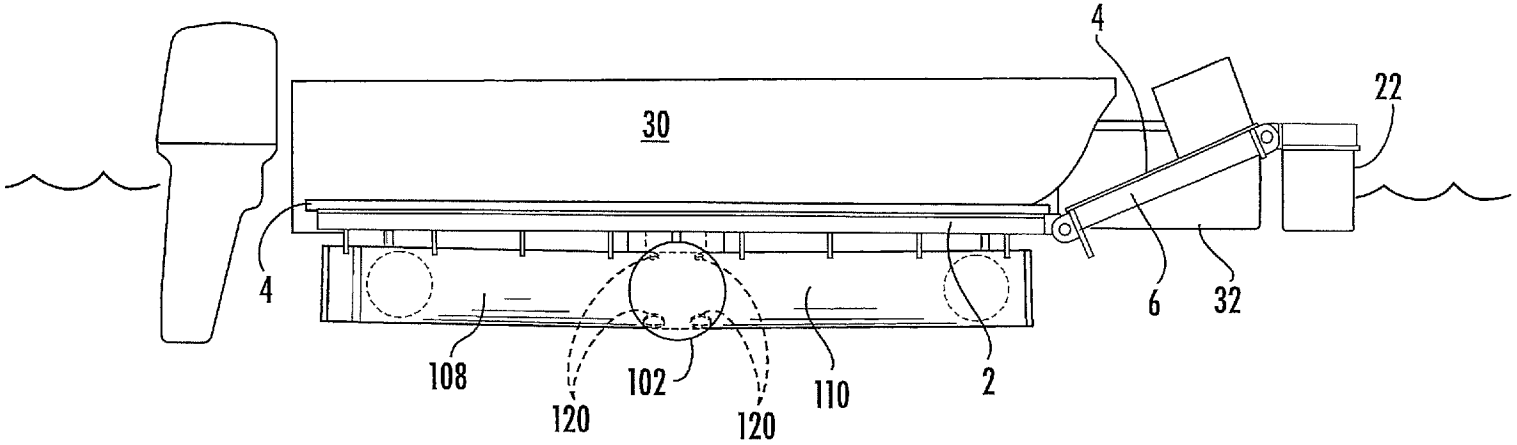
FIG. 14 shows a side elevation of the flotation elements of FIG. 11 mounted under the boat frame with the boat lift partially submersed.

In the position shown in FIG. 13 with the frame 2 and deck submerged, a boat may be driven or otherwise positioned onto the deck of the boat lift frame. After the boat is secured in position on the frame, such as shown in FIG. 14, the water receiving inlets are closed, such as by actuation of the valves. The submersible pumps are actuated, and water is pumped from the flotation tank construct. FIG. 12. Air enters the flotation tank construct through the air vents 116 to replace the water. The vents preferably have conduits 124 to ensure that the openings of the air vents are above the water line when the boat lift frame is submersed.

Figure 15:
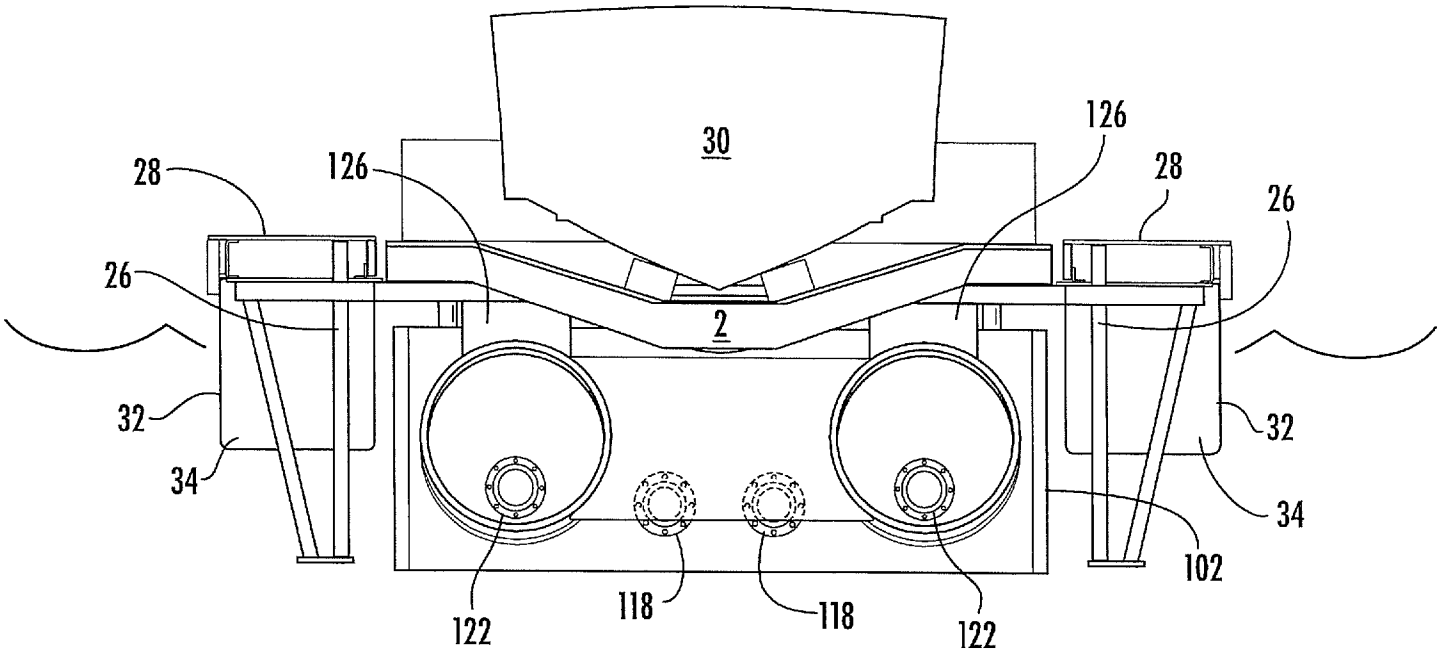
FIG. 15 shows the rear elevation of the flotation elements of FIG. 11 mounted under the boat frame with the boat lift floating.
Figure 16:
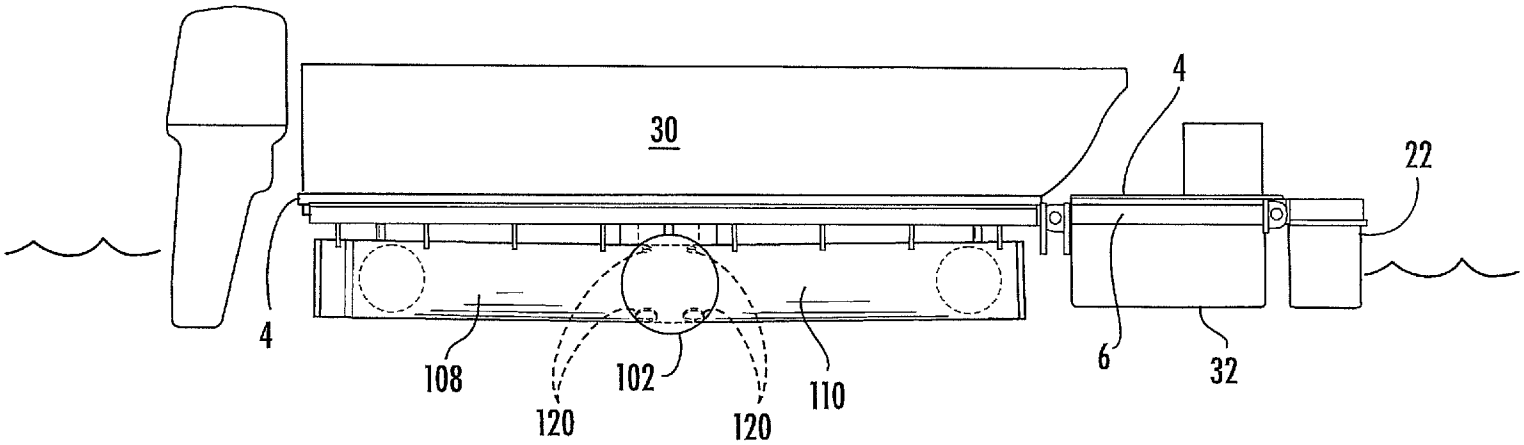
FIG. 16 shows the side elevation of the flotation elements of FIG. 11 mounted under the boat frame with the boat lift floating.

As water is expelled from the flotation tank construct and air enters the flotation tank construct, the lift frame floats. The submersible pumps are actuated until the boat lift frame reaches the desired level, which is typically after the bottom of the boat is completely above the water line, and the boat is at a level that makes entering and exiting the boat by means of the catwalks convenient. FIG. 15, FIG. 16.

The boat may subsequently be lowered for use by opening the valves to the water receiving inlets 118 and allowing water to enter the flotation tank construct. The boat lift frame and the boat are submersed sufficiently to allow the boat to float above the boat lift frame sufficiently to allow the boat to exit the boat lift frame. In one embodiment, submersible pumps are used that can reverse the flow of water so as to pump water into the flotation tank construct to flood the flotation tank construct.

Figure 18:
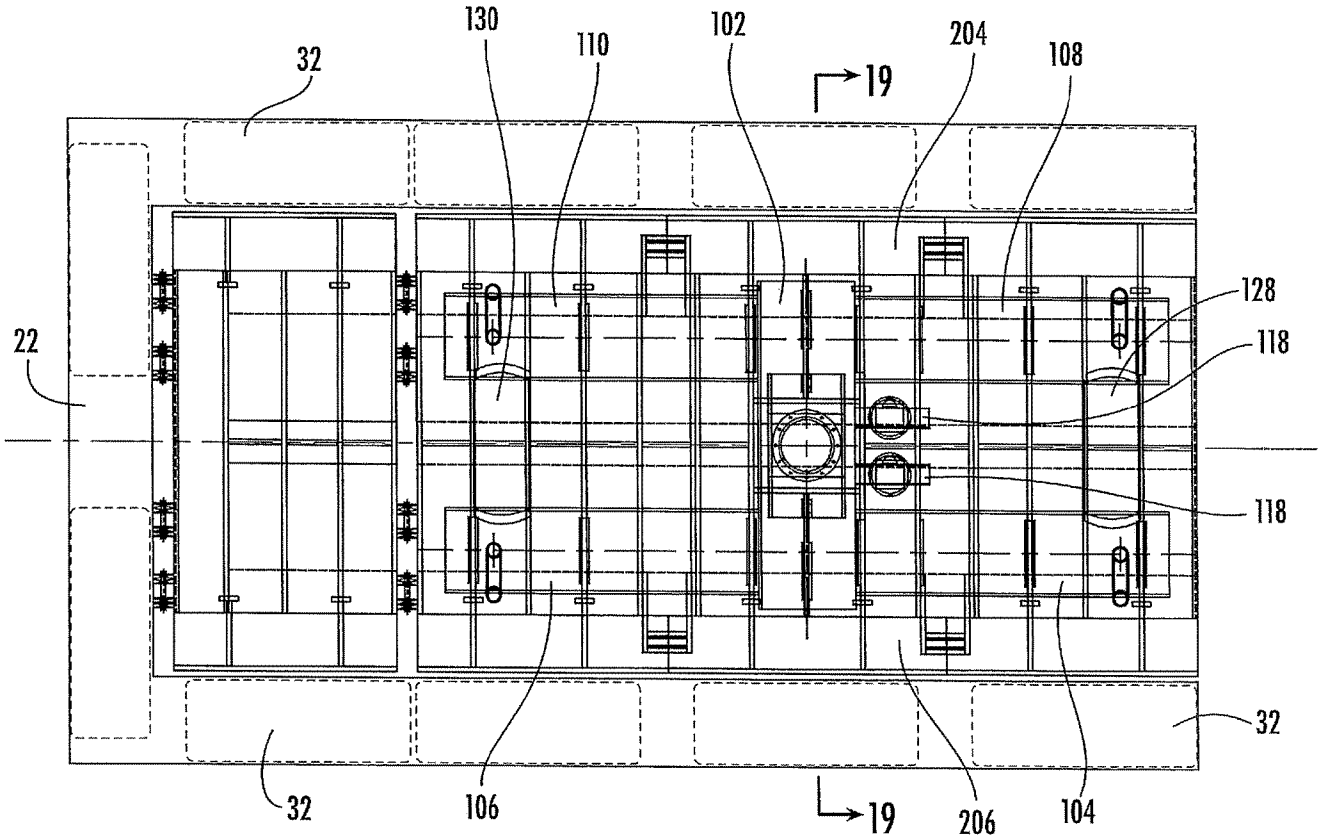
FIG. 18 is a top plan view of an additional embodiment of the boat lift.
Figure 19:
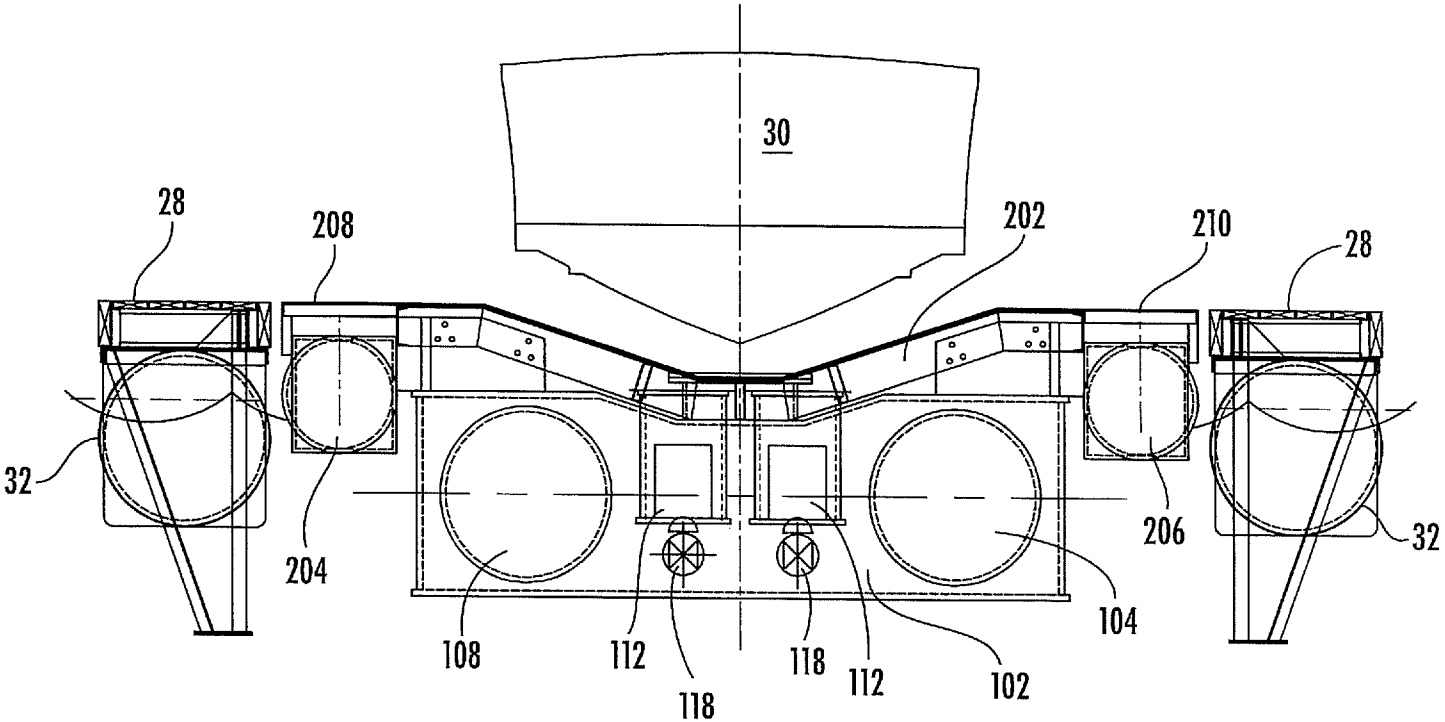
FIG. 19 is a sectioned view taken essentially along line 19-19 of the boat lift of FIG. 18.

FIGS. 18 and 19 show a boat lift having auxiliary flotation tanks positioned under catwalks. The auxiliary flotation tanks 204, 206 and catwalks 208, 210 are attached to the boat lift and float with the boat lift.

Figure 17:
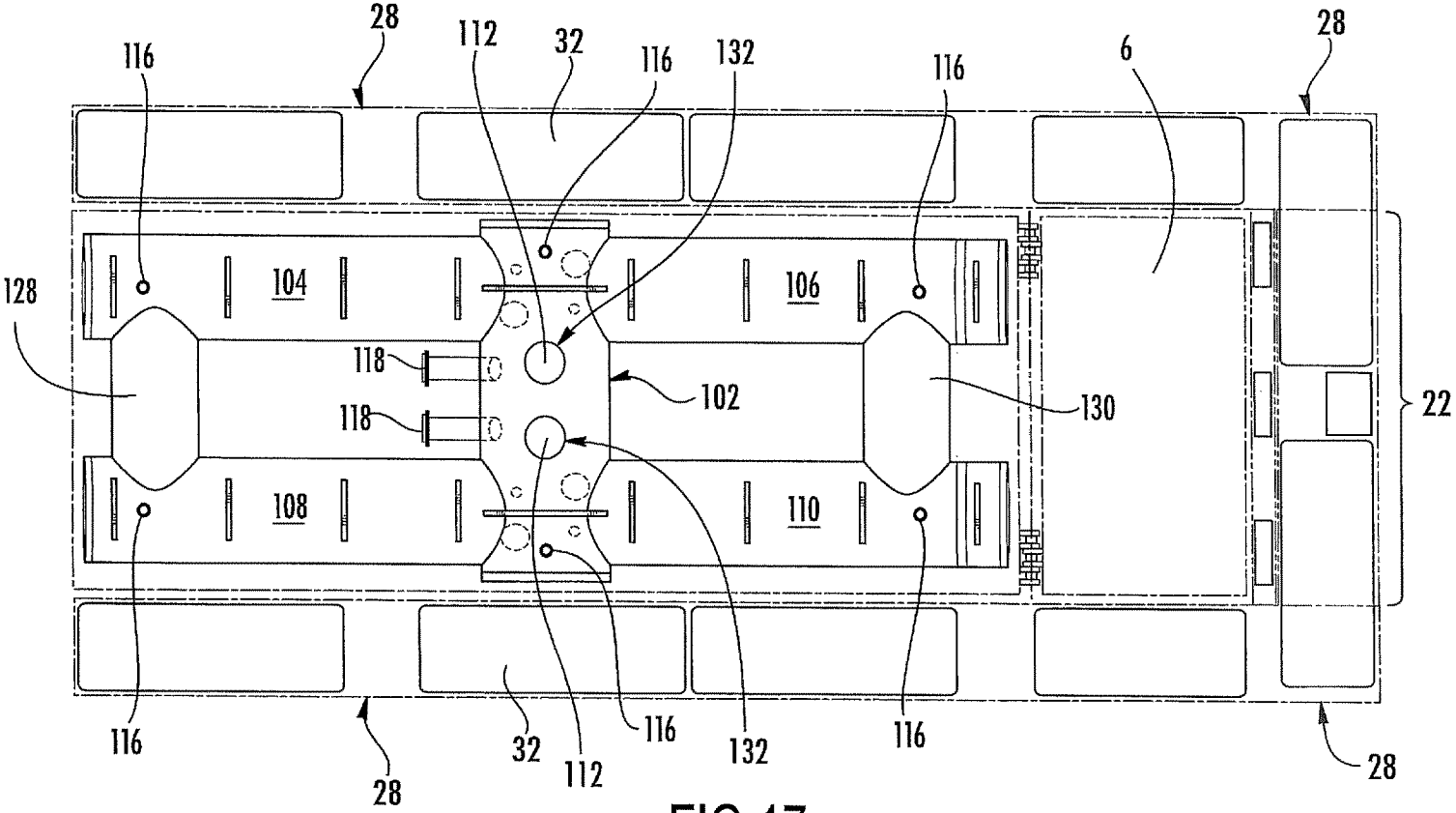
FIG. 17 is a top plan view of the flotation elements of FIG. 11, with flotation elements for catwalks and bulkhead.

Operationally, the boat lift shown in the embodiment of FIGS. 18 and 19 is the same as the embodiment of FIG. 10 or FIG. 17. The water level of the auxiliary flotation tanks 204, 206 is static as flotation tanks 104, 106, 108 and 110, change to cause movement of the boat lift. The water level in the auxiliary tanks may be calculated to assist in balancing the boat lift toward a horizontal position as the boat enters and leaves the boat lift. While FIG. 19 shows the boat lift in the elevated position and substantially level with the catwalks, the boat lift may be lowered by flooding the flotation tanks as disclosed herein. See FIG. 13.

In another embodiment, the auxiliary tanks 204, 206 are flooded as the boat lift submerges. In an embodiment, the auxiliary tanks communicate with tanks 104, 106, 108 and 110 so that water is received and expelled from the auxiliary tanks as the tanks 104, 106, 108 and 110 receive and expel water to control flotation levels of the boat lift.

In one embodiment, each of the auxiliary tanks 204, 206 and its associated catwalks 208, 210 are supported by a separate frame from the frame of the boat lift, thereby forming a construct that is detachable from the remainder of the boat lift. It is preferred that the structures for the auxiliary tanks are attached to the boat lift with threaded fasteners. This allows the boat lift to be assembled at an installation site, making the center portion of the boat lift narrower for transportation by truck. The auxiliary tanks may provide additional flotation, which allows for smaller and narrower first flotation tank and second flotation tank, and allowing an overall narrower main portion of the boat lift for truck transportation.

Figure 20:
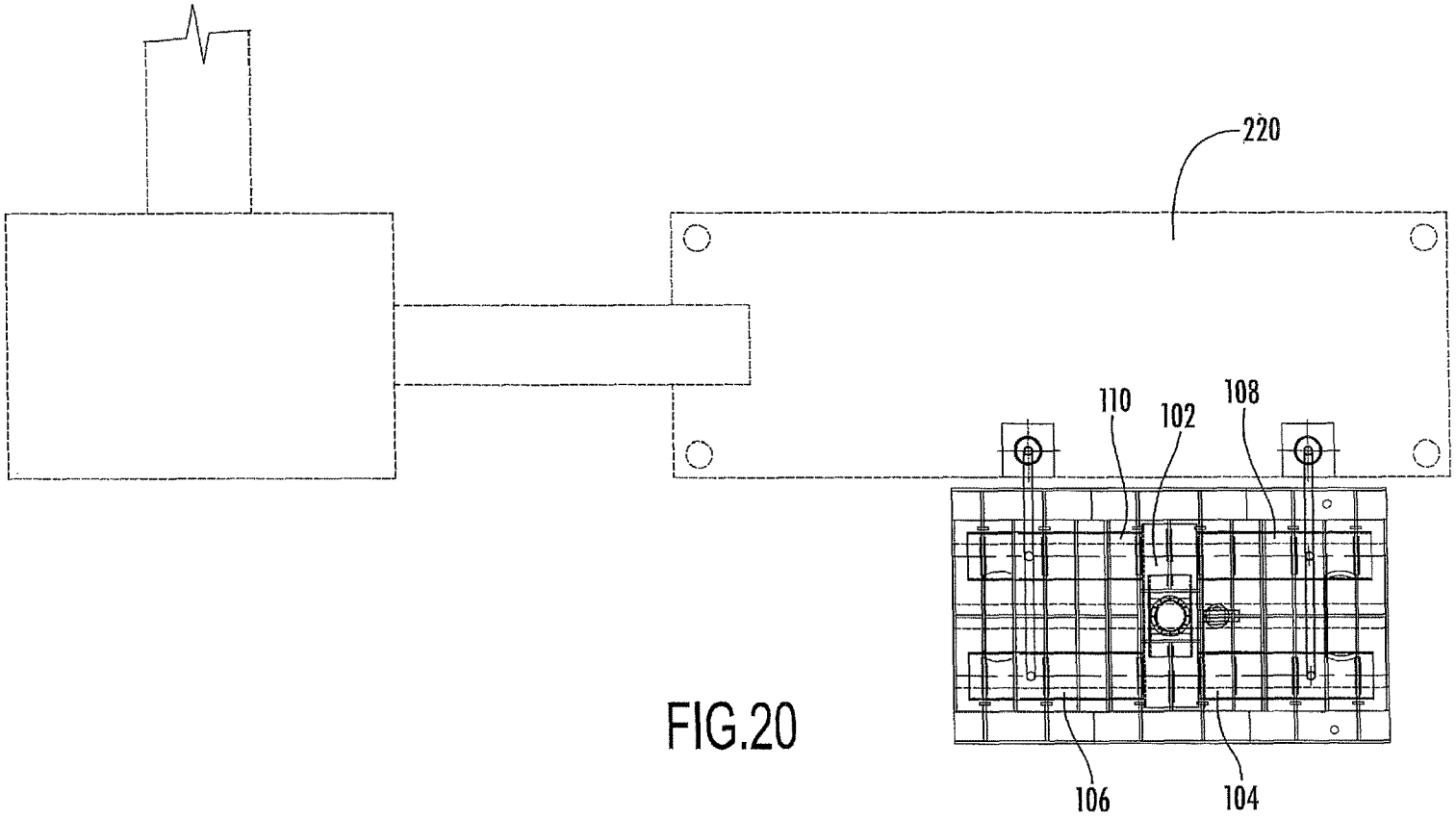
FIG. 20 is a top plan view of an embodiment of the boat lift attached to a floating dock instead of a bulkhead.
Figure 21:
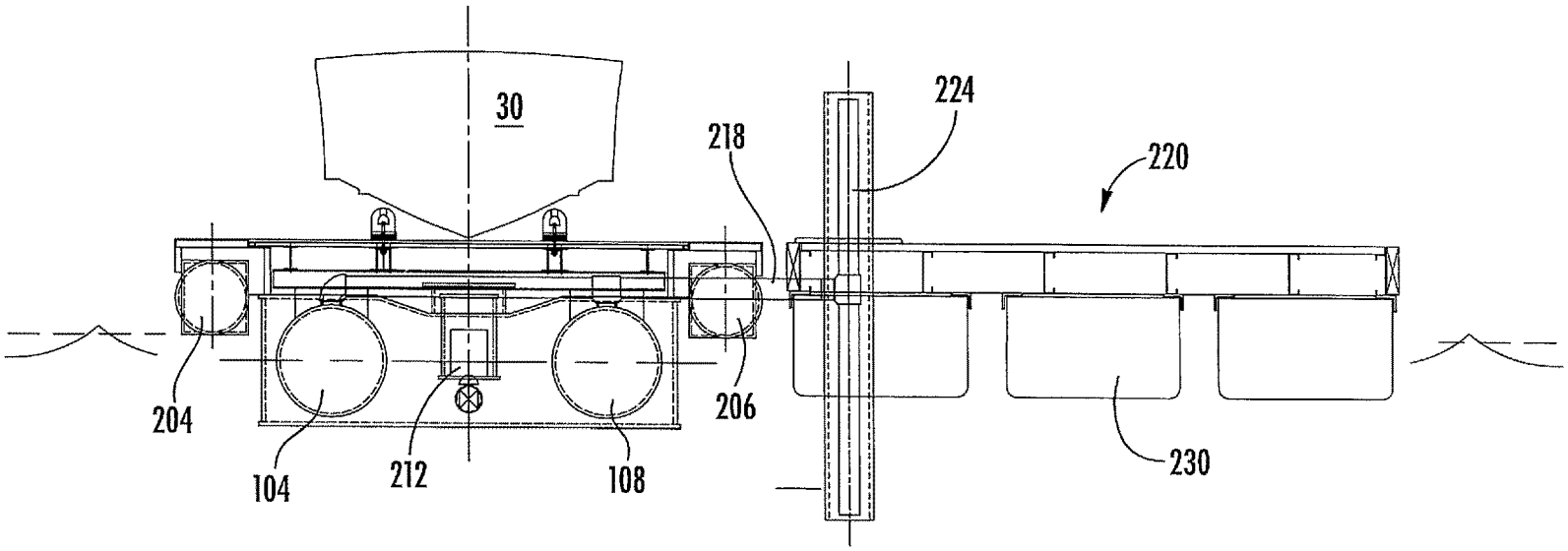
FIG. 21 is an elevation of the boat lift of FIG. 20 attached to a floating dock instead of a bulkhead.

The embodiment of FIGS. 18 and 19 may be attached to a bulkhead system that may comprise catwalks. However, in another embodiment the boat lift of this embodiment is attached to a floating dock 220, as shown in FIGS. 20 and 21, rather than a bulkhead. A floating dock is a dock that is mounted on flotation devices so that the dock moves vertically as water levels rise and fall. Typically, horizontal movement of the dock is restricted by piles, which maybe driven into the earth and to which the dock is mounted. The piles permit vertical movement of the dock relative to the piles, such as by pile guides mounted to the dock though which the piles traverse.

Operationally, the boat lift shown in the embodiment of FIGS. 20 and 21 is the similar to the embodiment of FIG. 18 or FIG. 19. This embodiment is preferred to have auxiliary tanks 204, 206 and catwalks 208, 210. The flotation tanks and transverse tank are flooded to lower the boatlift and the floating dock. As shown in the relevant figures, the dock is rigidly attached to the boat lift so that the dock is raised and lowered as the boat lift is raised and lowered. Water is removed from the flotation tanks and transverse tank by the pump or pumps and replaced with air to float the dock and boat lift. Only one pump 212 is shown, although multiple pumps may be employed.

Flotation for the dock 220 may be provided by closed dock tanks 230. Ballast may be provided or eliminated in the tanks 230 to vary flotation of the dock and the boat lift as required. Multiple piles and pile guides for the dock are preferred.

Electrical power may also be provided to the boat lift from the floating dock, such as by conduit 218. The electrical power powers a pump or pumps to evacuate water from the flotation tanks. In another embodiment, power for an air compressor, or alternatively, compressed supplied to the boat lift from the floating dock, or hydraulic fluid under may be used to power appropriate pumps. Air may be vented from the flotation tanks as they are flooded through a vent pipe 224. The preferred embodiment has catwalks attached to the boat lift and over the auxiliary tank as shown in FIGS. 20 and 21. wherein the first auxiliary tank is positioned generally parallel to and to the outside of the first flotation tank, and the second auxiliary tank is positioned generally parallel to, and to the outside of, the second flotation tank.

A plurality of auxiliary tanks may be employed. The plurality of auxiliary tanks provides different levels of ballast or flotation at areas along the length of the boat lift by filling the tanks to different water levels from front to rear. This feature allows the boat lift to be balanced for the particular vessel and vessel propulsion configuration. The auxiliary tanks may be of desired geometric configuration, such as a rectangular or round cross section, or other shapes. FIG. 19.

It is preferred that the construct for the auxiliary tanks 204, 206 is modular. The supporting structures for the auxiliary tanks may be detachable, such as by attaching the supporting structures to the boat lift with threaded fasteners. The modular aspect allows the level of ballast or flotation for the boat lift to be increased or decreased separately from the dynamic water levels of flotation tanks, so that an owner can change the overall flotation of the boat lift if the owner acquires a larger or small vessel. Through the use of a plurality of auxiliary tanks on each side of the flotation tanks, the balance point of the boat lift can also be changed from time to time by adding or removing auxiliary tanks and/or changing the ballast (water) levels in the plurality of auxiliary tanks.

The boat lift according to the invention is a closed system when the flotation tanks are not taking on water or expelling water as described herein. This structure is contrasted with other boat lifts and docks that have holes in the bottom of tanks that remain open at all times, with water flow regulated by air pressure within the tanks. Such holes or inlets are subject to fouling, particularly in salt water environments.

What is claimed:

1. A boat lift, comprising:

a boat lift frame constructed and arranged to receive a boat hull on an upper surface thereof, the boat lift frame comprising:

a transverse flotation tank positioned under the boat lift frame;

a first flotation tank that extends through the transverse flotation tank;

a second flotation tank that extends through the transverse flotation tank, wherein the first flotation tank is spaced apart from the second flotation tank;

the transverse flotation tank being in hydraulic communication with the first flotation tank and the second flotation tank, wherein the transverse flotation tank comprises:

a water receiving inlet that communicates with the transverse flotation tank; and a pump that communicates with a water outlet;

wherein, in use, water received in the transverse flotation tank, the first flotation tank and the second flotation tank is expelled from the transverse flotation tank, the first flotation tank and the second flotation tank by the pump and through the water outlet.

2. A boat lift as described in claim 1, wherein a first side of the first flotation tank that is on a first side of the transverse flotation tank is disposed at an incline away from the transverse flotation tank and a second side of the first flotation tank that is on a second side of the transverse flotation tank is disposed at an incline away from the transverse flotation tank.

3. A boat lift as described in claim 1, further comprising a pump, wherein the pump withdraws water from the first flotation tank through the transverse flotation tank.

4. A boat lift as described in claim 1, the boat lift further comprising a bulkhead and a hinged frame section, wherein the hinged frame section is hingably connected to the boat lift frame and hingably connected to the bulkhead.

5. A boat lift as described in claim 1, further comprising:

a plurality of lateral stabilizers;

the boat lift frame comprising brackets for receiving the plurality of lateral stabilizers, wherein the lateral stabilizers and brackets are constructed and arranged to permit movement of the boat lift frame in a direction dictated by movement of a hinged frame section that is hingably connected to the boat lift frame and to retard movement of the boat lift frame in other directions.

6. A boat lift as described in claim 1, wherein a first lateral stabilizer is positioned to an outside of the boat lift frame, and a second lateral stabilizer is positioned on the outside of the boat lift frame, the boat lift frame having a first bracket comprising a slot for receiving the first lateral stabilizer therein and having a second bracket comprising a slot for receiving the second lateral stabilizer therein.

7. A boat lift as described in claim 1, wherein a catwalk that is positioned along a length of the boat lift frame comprises a tank for receiving water therein, the tank comprising a water inlet and a water outlet for regulating a water level in the tank and thereby regulating a flotation height of the catwalk.

8. A boat lift as described in claim 1, wherein the water receiving inlet comprises a valve that regulates opening and closing of the water receiving inlet.

9. A boat lift as described in claim 1, wherein a first lateral stabilizer is positioned to an outside of the boat lift frame, and a second lateral stabilizer is positioned on the outside of the boat lift frame, the boat lift frame having a first bracket comprising a slot for receiving the first lateral stabilizer therein and having a second bracket comprising a slot for receiving the second lateral stabilizer therein, wherein the first lateral stabilizer and slot and the second lateral stabilizer and slot limit travel of the boat lift frame while permitting the boat lift frame to float within a body of water.

10. A boat lift as described in claim 1, further comprising a catwalk and a bulkhead, wherein the catwalk and the bulkhead each comprise a flotation device and wherein the flotation device for the catwalk, and the flotation device the bulkhead are constructed and arranged to provide an adjustable flotation height for the catwalk and for the bulkhead that is independent of flotation of the boat lift frame.

11. A boat lift as described in claim 1, further comprising a transverse member that is connected at one end to the first flotation tank and is connected at an opposite end to the second flotation tank.

12. A boat lift as described in claim 1, wherein the first flotation tank and the second flotation tank are in a substantially parallel relationship with each other.

13. A boat lift as described in claim 1, wherein the diameter of the transverse flotation tank is larger than the diameter of the first flotation tank where the first flotation tank joins the transverse flotation tank.

14. A boat lift as described in claim 1, wherein the boat lift is attached to a floating dock.

15. A boat lift as described in claim 1, further comprising a first auxiliary tank and a second auxiliary tank, wherein the first auxiliary tank is positioned generally parallel to and to the outside of the first flotation tank, and the second auxiliary tank is positioned generally parallel to, and to the outside of, the second flotation tank.

16. A boat lift as described in claim 1, further comprising a floating catwalk positioned generally parallel to the first flotation tank, wherein a flotation level of the first flotation tank is independent of a flotation level of the floating catwalk.

17. A boat lift as described in claim 1, wherein the transverse flotation tank, the first flotation tank, and the second flotation tank are constructed of high density polyethylene (HDPE).

18. A boat lift as described in claim 1, wherein the transverse flotation tank, the first flotation tank, and the second flotation tank are constructed of high density polyethylene (HDPE) pipe.

19. A boat lift as described in claim 1, wherein the transverse flotation tank, the first flotation tank, and the second flotation tank are constructed of high density polyethylene (HDPE) and the first flotation tank and the second flotation are mounted to the transverse flotation by welding the high density polyethylene (HDPE).

* * * * *